United States Patent [19]

Carlson

[11] 4,297,029

[45] Oct. 27, 1981

[54] APPARATUS AND METHOD FOR DIAGNOSTIC ENTRY

[75] Inventor: Gerald E. Carlson, Webster, N.Y.

[73] Assignee: Xerox Corporation, Stamford, Conn.

[21] Appl. No.: 28,636

[22] Filed: Apr. 9, 1979

[51] Int. Cl.[3] ..... G03G 15/00

[52] U.S. Cl. ..... 355/133; 355/14 R; 371/15; 371/29

[58] Field of Search ..... 355/3 R, 14 R, 133; 371/15, 16, 29; 364/518

[56] References Cited

U.S. PATENT DOCUMENTS 4,161,277 7/1979 Steiner ..... 371/29 X 4,162,396 7/1979 Howard et al. ..... 371/29 X

*Primary Examiner*—Fred L. Braun

*Attorney, Agent, or Firm*—Ronald F. Chapuran

[57] ABSTRACT

Diagnostic capability is provided by setting a machine in a jam condition and using non-diagnostic dedicated circuitry. A selector switch is switched from a first predetermined number to a second predetermined number while simultaneously activating a start operation switch. Machine logic is then advanced to a diagnostic state. To exit the diagnostic state, a routine jam clearance is accomplished and the machine returns to the stand by state for normal operation.

6 Claims, 6 Drawing Figures

116
CONTROL
74
76
STR
TR
82
CAR
72
AR
"0"
118
P/FF
IEF/F
90
ALU
88
78
ROW DECODE
RAR
45
114
MUX
70
64
BR
46
RAM
93
48
ℓ0
ℓ1
CROM
READ/WRITE PAGE SELECT
RAM I/O
117
64
95
BUS DRIVERS
64
130
91
IDR
Z
S COUNTER
92
SPLIT PLA CONTROL
54
94
NRESET
NINT
NTEST
128
NMEMRD
NIORD
NIOWR
NINTA
NSI

APPARATUS AND METHOD FOR DIAGNOSTIC ENTRY

The present invention relates generally to electronically controlled devices and more particularly to diagnostic tests of electronically controlled devices.

Diagnostic systems have proven to be a helpful service tool on electronically controlled devices and in particular on electronically controlled electrophotographic machines. Generally associated with diagnostic systems are suitable diagnostic circuitry and related memory devices. Typically diagnostic systems include sending test signals through a device or circuitry to be tested and comparing the return signal with a reference signal. This type of system is shown in U.S. Pat. Nos. 3,714,571; 3,889,109 and 3,916,306. Other diagnostic methods include separate test apparatus for interconnecting with the module to be tested in order to perform the diagnostics as described in U.S. Pat. No. 3,622,877. Another example is U.S. Pat. No. 3,880,516, assigned to the same assignee as the present invention. Diagnostics often include circuitry for interrupting machine operation upon detection of a specific fault and manifestation of the fault, usually energizing a lamp. Such a system is shown in U.S. Pat. No. 3,813,157. Other control tools related to diagnostics are mechanical locks to vary operator freedom to make adjustable machine settings. This technique is shown in U.S. Pat. No. 4,023,901 also assigned to the same assignee as the present invention.

In most cases, a dedicated diagnostic switch or equivalent device and associated circuitry are used to switch the logic into a diagnostic mode. In many machines, however, due to cost considerations, dedicated diagnostic switches and circuitry are not available or have not been provided. These machines may have no diagnostic capability or at best limited diagnostic capability even though sufficient memory space may be available in the machine controller to provide a greater diagnostic capability. In many of these machines it later becomes apparent that diagnostics would be a very valuable service tool. However, since there is no dedicated switch and associated circuitry for entering a diagnostic mode, adding a diagnostic capability could require costly hardware additions and modifications. Even in the original design of a machine, dedicated diagnostic switches and related circuitry adds to the machine cost. It would be desirable, therefore, in a machine having no dedicated diagnostic switch with associated circuitry, to provide an inexpensive means to incorporate diagnostic capability within the machine and the means to be able to access the diagnostic capability of the machine.

A principal object of the present invention, therefore, is to provide a new and improved means for diagnostics in an electronic controlled device.

Briefly, the present invention is concerned with providing and accessing diagnostics in an electrophotographic machine. The diagnostic mode is accessed by first manually placing the machine in a jam condition. A number select switch is then set at a first predetermined number. The start of operation switch is then activated while the number select switch is simultaneously decremented to a second predetermined number. In a particular embodiment, the copy selector switch of an electrophotographic machine is set to 38 and the tens position and units position are then sequentially decremented to zero. This combination of events activates logic in the machine to advance the machine to the diagnostic state. To exit the diagnostic state, a routine jam clearance procedure is accomplished and the machine returns to the stand by state, ready to make copies.

For a better understanding of the present invention, reference may be had to the accompanying drawings wherein the same reference numerals have been applied to like parts and wherein.

Figure 2:
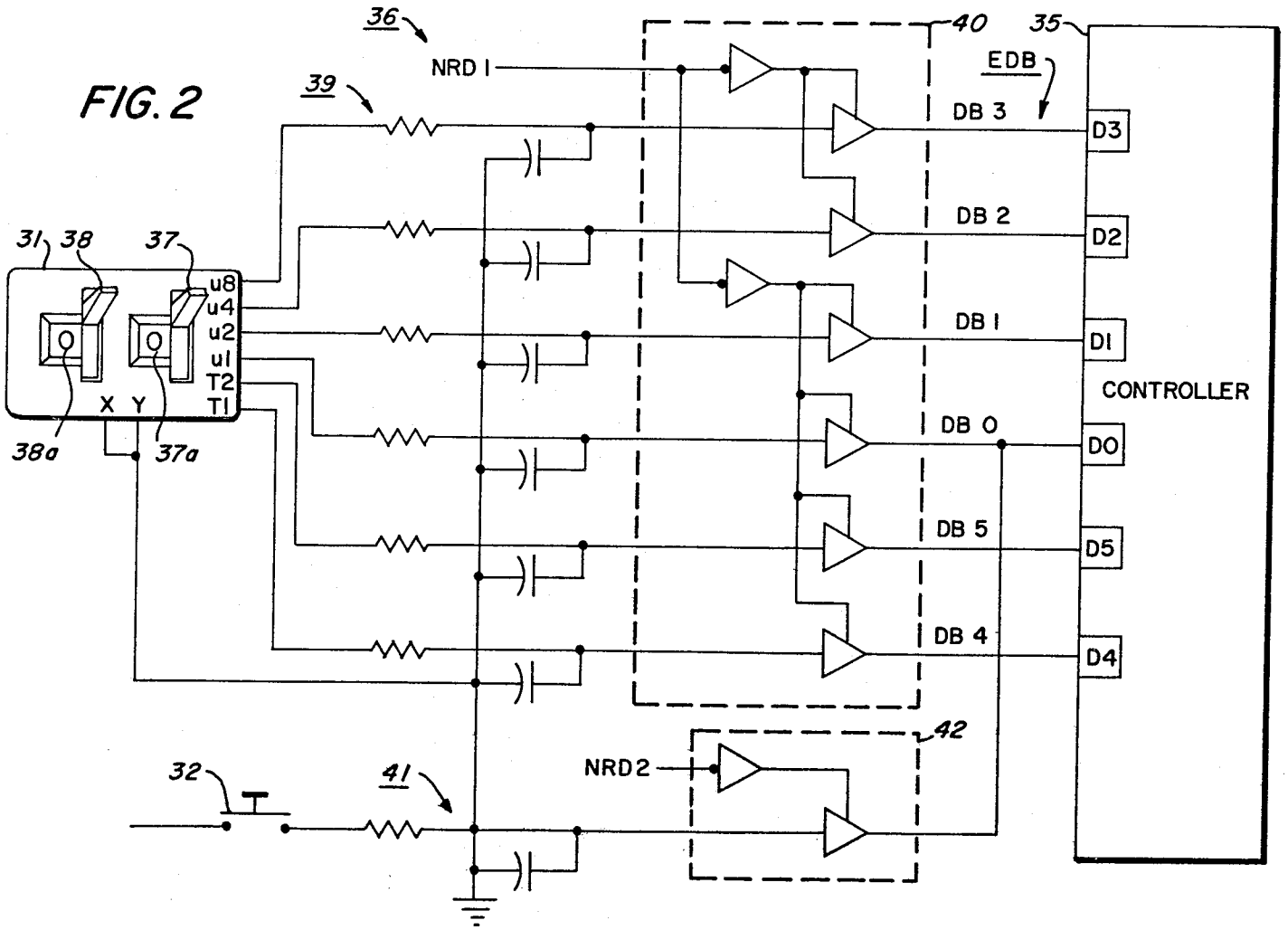
FIG. 2 is a detailed schematic representation of the present invention.
Figure 3A:
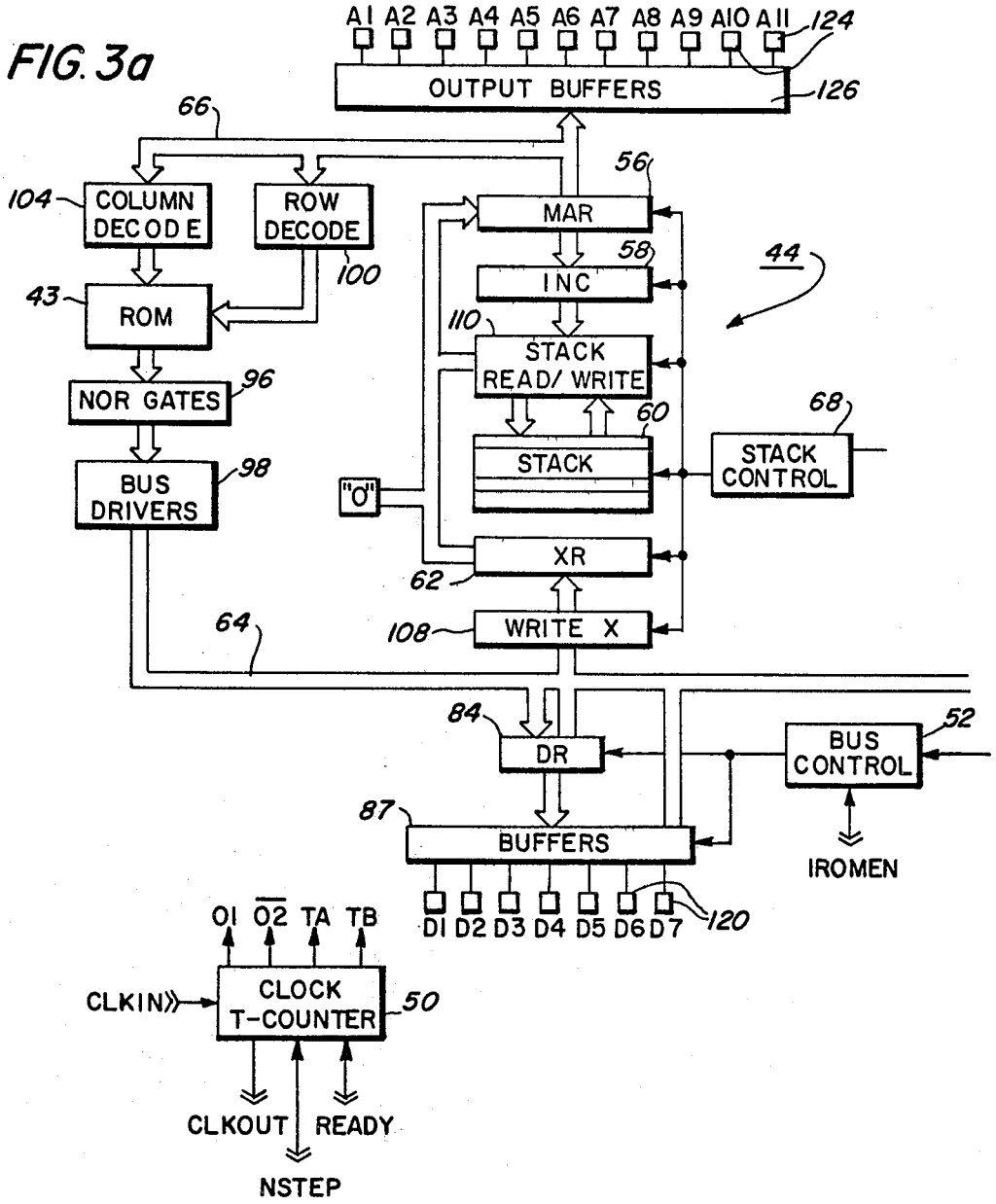
Figure 3B:
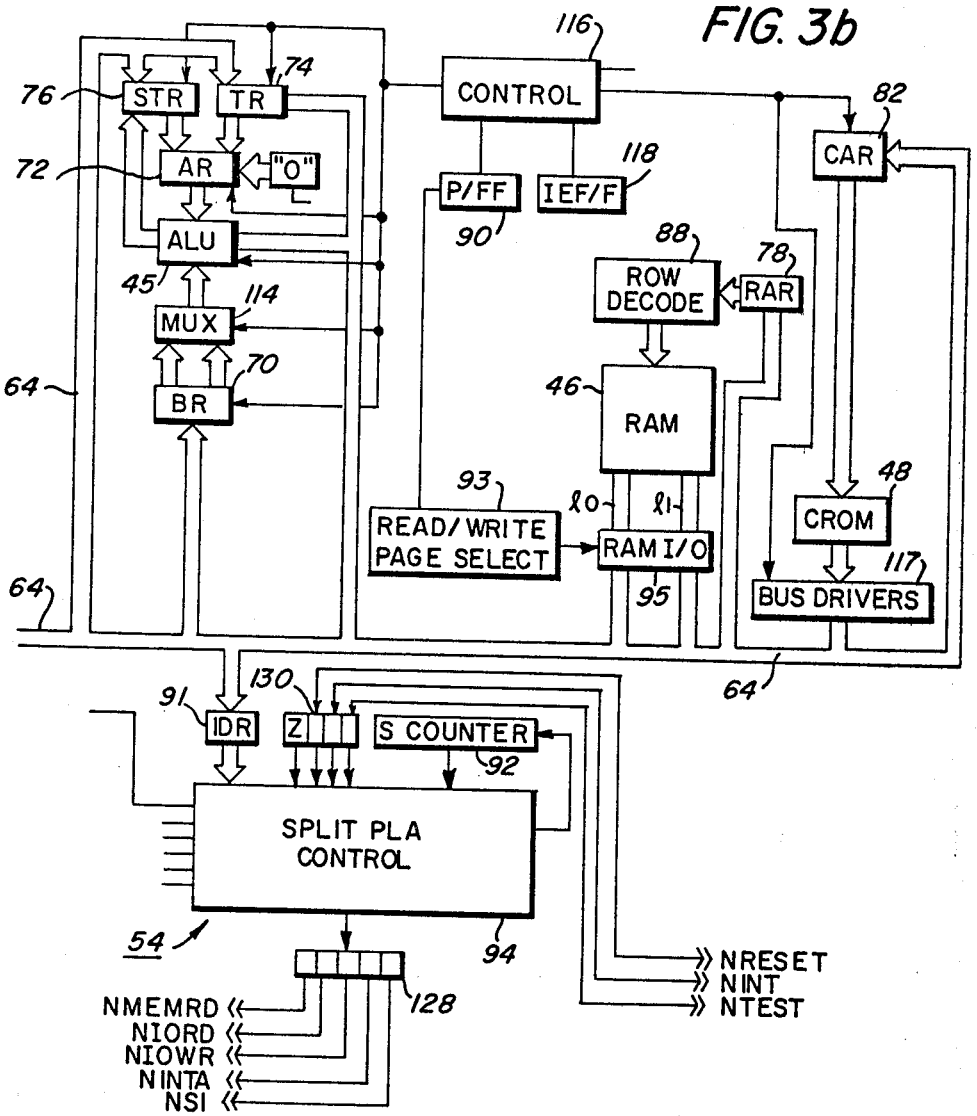
Figure 4:
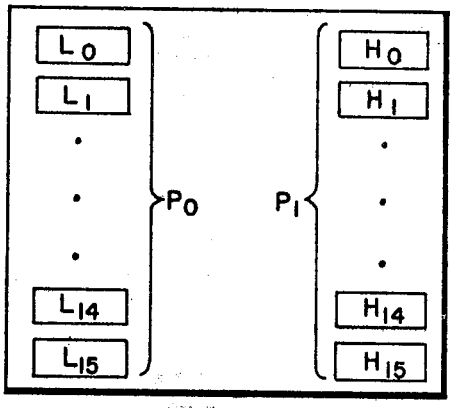
Figure 5:
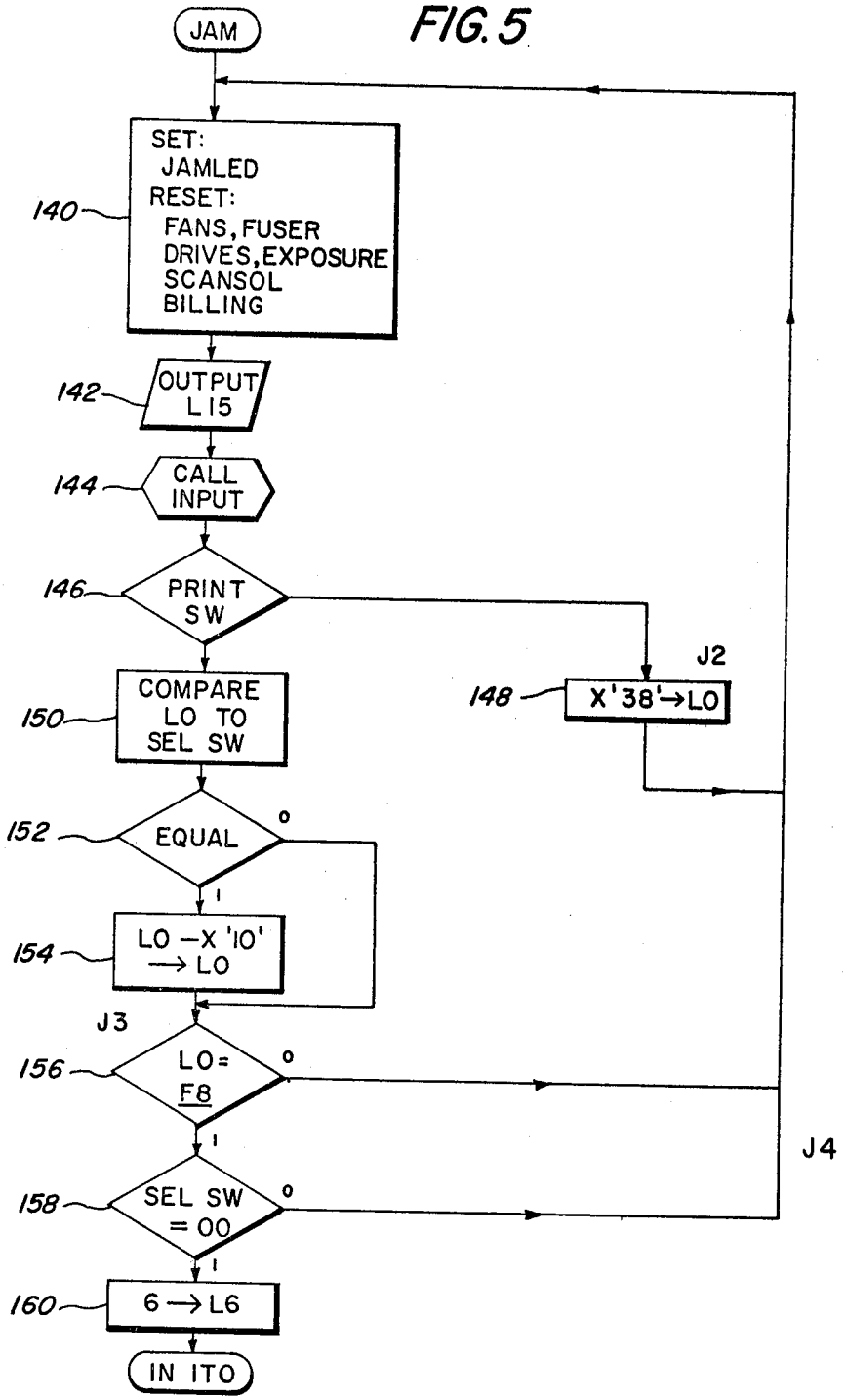

FIGS. 3*a* and 3*b* are a block diagram of the controller shown in FIG. 2;

FIG. 4 is a block diagram of the RAM memory shown in FIG. 3;

FIG. 5 is a flow chart showing the sequence of operation in accordance with the present invention.

Figure 1:
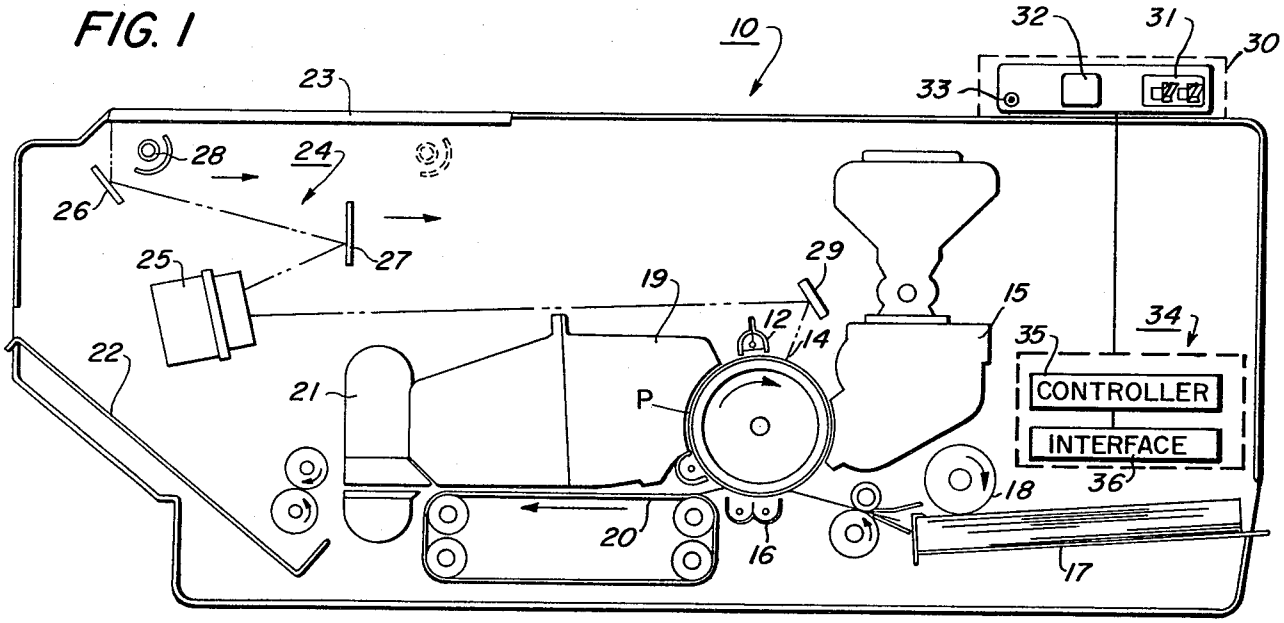
FIG. 1 is a schematic representation of an electrophotographic machine incorporating the present invention.

Referring now to FIG. 1, there is shown an electrophotographic machine 10 incorporating the present invention. Initially, the photoconductive drum surface P, rotating in a clockwise direction as shown, is uniformly charged by means of a corona generator 12 positioned within a charging station. The charged drum surface P, is advanced into an imaging station 14 for projecting a stripwise flowing light image of an original document onto the charged drum surface for recording on the drum a latent electrostatic image. Next, in the direction of drum rotation is a developing station 15 for making the latent electrostatic image visible by applying an electroscopic marking powder (toner) to the photoconductive surface. The developed image is then forwarded to a transfer station 16 for bringing a sheet of final support material into contact with the toner image and transferring the image from the plate to the support sheet.

In operation, a supply of cut sheets are supported within the machine by means of a paper holder 17. Feed rollers 18 engage the uppermost sheet in the holder 17 to separate the top sheet from the remainder of the stack and advance the sheet into the transfer station 16 in synchronism with the developed image on the photoconductive plate surface. After transfer, the drum surface P is passed through a cleaning station 19 for removal of the residual toner remaining on the surface. Upon completion of the image transfer operation, the toner bearing support sheet is stripped from the drum surface and placed upon a moving vacuum transport 20 advancing the support sheet into a thermal fusing station 21 for permanently fixing the toner image to the sheet. The copy sheet with the fused image is then forwarded from the fuser into a collecting tray 22.

The original document to be reproduced is placed image side down upon a horizontal transparent viewing platen 23 and the stationary original is scanned by means of the moving optical system 24 as shown by the arrows. The scanning system 24 includes a lens 25, a pair of cooperating movable scanning mirrors 26 and 27, and a lamp 28. The lens 25 is a half-lens objective having a reflecting surface at the stop position to simulate a full lens system. Mirror 26, moves from a home position, directly below the left hand margin of the platen to an end of scan position below the opposite margin of the platen. The rate of travel of the mirror 26 is synchronized to the velocity of the drum surface P. The second mirror 27 is simultaneously moved in the same direction as the scanning mirror at half the scanning rate. As the two mirrors 26, 27 and lamp 28 sweep across the platen surface, a stripwise image of each incremental area of the document is reflected from mirror 26 to mirror 27, in and out of lens 25 to stationary mirror 29 to drum surface P.

In accordance with the present invention, there is represented in FIG. 1 an operator console generally shown at 30 including a copy selector switch 31, a print switch 32 and an indicator lamp or light emitting diode (LED) 33 electrically connected to a control board generally shown at 34 including a controller 35 and interface circuitry 36 and other logic circuitry (not shown). It should be noted that the operator console 30 and control board 34 are shown in phantom to indicate an arbitrary location relative to the machine components in FIG. 1. It should be understood that the operator console 30 will be in a location easily accessible to the operator and the control board 34 positioned in accordance with accessibility and machine configuration and restraints. The control board 34 and related elements (not shown) external to the control board 34 such as power supplies, sensors, motors and relays provide the coordinated movement and operation of the various components of the machine 10.

The relationship of copy selector and print switches 31, 32 with the controller 35 and interface 36 is illustrated in FIG. 2. In normal operation, the machine operator selects the desired number of copies with the selector switch 31, to be reproduced by machine initiates the print button 32 and the machine 10 produces the desired number of copies. Preferably, switch 31 is a two pole lever wheel selector switch. One lever 37, the right pole, selects the units position of the selected number and the second lever 38, the left pole, selects the tens position. There is a window 37*a*, 38*a* adjacent each lever for displaying of the selected number. There are 10 detent position for each lever and for each detent position only one number appears in the window. The levers are shown in the top position and the numbers increase as the levers move from top to bottom. There are six terminal connections as shown identified from top to bottom as U8, U4, U2, U1, T2 and T1. There is provided a binary coded decimal complement output code and the switch positions, numbering and truth table are shown in Table I.

TABLE I

SWITCH POSITIONS, NUMBERING AND TRUTH TABLE

| WINDOW | LEFT POLE (Tens Position) COMMON X CONNECTED TO | | | | RIGHT POLE (Units Position) COMMON Y CONNECTED TO | | | |
|---|---|---|---|---|---|---|---|---|
| READOUT | T1 | T2 | T4 | T8 | U1 | U2 | U4 | U8 |
| 0 | x | x | x | x | x | x | x | x |
| 1 | | x | x | x | | x | x | x |
| 2 | x | | x | x | x | | x | x |
| 3 | | | x | x | | | x | x |
| 4 | | | | | x | x | | x |
| 5 | | | | | | x | | x |
| 6 | | | | | x | | | x |
| 7 | | | | | | | | x |
| 8 | | | | | x | x | x | |
| 9 | | | | | | x | x | |

As seen in this Table the maximum count for this specific switch is 39. The selector switch outputs U8, U4, U2, U1, T2 and T1, are connected to controller 35 through interface 36 including a suitable capacitive and resistive network 39 and a suitable tri-state buffer 40 such as Texas Instrument TTL chip #74367. The six outputs DB3, DB2, DB1, DB0, DB5 and DB4 from buffer 40 correspond to switch outputs U8, U4, U2, U1, T2 and T1 and comprise an external data bus EDB connected to controller 35. The external data bus is connected to data pins D3, D2, D1, D0, D5 and D4 of controller 35. Similarly, the output of print switch 32 is connected through interface 36 including capacitive and resistive network 41 and tri-state buffer 42. Signals NRD1 and NRD2 are enabling signals connected to controller 35 through a suitable decoder. Only that portion of the buffer 42 connected to the print switch 32 is shown.

The controller 35 with reference to FIGS. 3*a* and 3*b*, is an integrated chip with main elements; read only memory ROM 43, stack area 44, arithmetic logic unit ALU 45, random access memory RAM 46, condition decode read only memory CROM 48, clock and T-counter 50, bus control 52, and control area 54. The stack area 44 includes a 12 bit memory address register MAR 56, a 12 bit incrementor INC 58 for use in next address generation, four 12 bit registers 60, organized as a push down stack to store subroutine and interrupt return addresses, a 12 bit transfer register XR 62 for transferring information from a data bus 64 to an address bus 66, and stack control circuitry 68. The ALU 45 operates with an 8 bit operand register BR 70, an 8 bit operand register AR 72, a temporary storage register TR 74 accessible to an application program and an 8 bit status register STR 76.

The RAM 46 as best seen in FIG. 4, operates with two groups or pages P0, P1 of 8 bit registers L0 through L15 and H0 through H15. These registers comprise the file of working or scratch pad registers accessible to the application program. RAM 46 also operates with a 4 bit address register BAR 78 for addressing the 16 scratch pad registers L0–L15 and H0–H15. The condition decode read only memory CROM 48 is used to decode the condition field of an instruction and is connected to data bus 64 through bus drivers 117. It includes a 3 to 8 decoder and a 3 bit CROM address register CAR 82. The RAM address register RAR 78, containing four sample and latch devices, receives a 4 bit encoded address comprising the least 4 significant bits of an instruction word from the data bus 64. The 4 bit encoded address is then put into the RAM row decode 88 to provide the word address signal for RAM 46.

The control area 54 includes an instruction decode register IDR 91 for capturing operation (OP) code information during each instruction fetch, an S counter 92 containing machine state information, and split programmed logic array PLA control 94 that generates internal control signals, external interface signals and next state feedback information to the S counter 92. The bus control 52 under control of PLA control 94, includes a data register DR 84 and data bus buffers 87 for capturing data during a memory read or data input operation or to store data to be driven off the chip during an output operation, Data is transferred on and off the chip through data pins 120 connected to buffers 87. Data pins 120 (D1, D2, D3, D4, D5, D6 and D7) are connected to external bus EDB as shown in FIG. 2.

The ROM 43 contains 1024 eight bit instruction words and is used to store all or part of the application program operating the system. The RAM 46 is addressed for a given word address by means of a RAM row decode circuit 88. One of two pages P0 or P1, of the RAM 46, is selected by a page select flip/flop PF/F 90 producing a page select signal applied through combined read/write page select circuitry 93 to RAM input/output circuitry RAMI/O 95. For a given word and page address, 8 bits are accessed and read out on line l0 (for page P0) and line l1 (for page P1) to input-/output circuitry 95, to data bus 64. Alternatively, data is written into the RAM 46 from the data bus 64 via the input/output circuitry 95.

The ROM 43 produces an 8 bit instruction word on data bus 64 through NOR gates 96 and bus drivers 98 during each instruction cycle. The ROM 43 is divided into eight 16 bit columns with each column producing one of 8 bits (D0–D7) of an instruction word. The ROM row address is a 12 bit address generated in row decode 100 in response to memory address register MAR 56 and the ROM 43 column address is an 8 bit address generated in column decode 104 in response to MAR 56.

The stack registers 60 serve as temporary storage for the return word address during subroutine and interrupt operations. A 12 bit address is stored in the stack registers upon initiation of a call instruction in order that this same address may be loaded back into MAR 56 upon execution of the subroutine or the interrupt. The 12 bit incrementer INC 58 takes a present address from MAR 56 and increments it to generate a next address. The 12 bit transfer register XR 62 transfers information from the data bus 64 to the address bus 66 through write circuitry WRITE X 108. Stack read/write circuitry 110 provides data transfer between INC 58, stack registers 60 and MAR 56. MAR 56, INC 58, STACK read/write 110, stack registers 60, XR 62 and WRITE X 108 are all controlled by stack control 68 receiving inputs from the Split PLA Control 94. Stack control 68 interprets commands from the PLA control 94 to determine branch-and-call-on-status, interrupt, or subroutine operations and to load an instruction word into MAR 56 to control transfer of bits to subroutine or buffer registers, and to control updating of the MAR 56.

ALU 45 is an 8 bit parallel logic network. Operand register AR 72 stores one of the operands for ALU 45 operations and may be cleared at any time through the use of a "0" reset. AR 72 receives its input from either the status register STR 76 or temporary register TR 74. STR 76 stores the status indications resulting from an arithmetic or logic operation. STR 76 also contains interrupt enable and page flip/flop status indicators from P/FF 90 and IEF/F 118. Status Register STR 76 receives its information either from the data bus 64 or from ALU 45. Temporary Register TR 74 receives and outputs data to data bus 64 to assist ALU 45 operations. Operand register BR 70 is the second operand register for ALU 45 receiving information from the data bus 64. BR 70 outputs its contents and the complement of its contents into a multiplexer MUX 114. Multiplexer MUX 114 selects the state of the contents to be placed into the ALU 45. ALU 45 and related registers receive control signals from control 116. The control 116 receives control signals from the Split PLA control 94 and also provides control signals to P F/F 90 and to interrupt enable IEF/F 118.

MAR 56 addresses 4096 memory locations. The internal ROM 43 occupies address locations 0000 to 1023. External memory devices, if required, can be addressed by address locations 1024 to 4095. The external memory receives address words on address pins 124 through output buffers 126 from the address bus 66. Output external interface signals eminate from the PLA control 94 and are placed into 5 flip-flop output circuits 128 as seen in FIG. 3*b*. Each one of the flip-flop circuits produces an external interface signal at its output.

The mnemonics for these five output signals are NMEMRD, NIORD, NIOWR, NINTA, and NS1. The NMEMRD (Not-Memory-Read) signal is used to gate external memory data onto the data bus 64 during a memory-read operation. The NIORD (Not-Input/Output-Read) signal is used to gate external input device data onto the data bus 64 during an input operation. The NIOWR (Not-Input/Output-Write) signal is used as a write-strobe to external output devices; that is, it indicates during an output operation, that data is available from the system. The NINTA (Not-Interrupt Acknowledge) signal indicates by logic 0 that an interrupt has been accepted. The NS1 (Not-S1-Cycle) signal indicates to a support system that an opcode fetch cycle is commencing. This may be used, for example, in conjunction with IROMEM to force the execution of a support-system supplied instruction. The IROMEN is an input interface signal received by bus control 52. IROMEN at logic 0 disables internal ROM 43 thereby allowing external memory to be addressed in the 0000 to 1023 locations.

Input interface signals are put into three input latch circuits 130 for receipt by the PLA control 94. The mnemonics for the input interface signals are NRESET, NINT, and NTEST. When the NRESET (Not-Reset) signal is at logic 0, it forces the data system into a "reset" state. During "reset" the flip-flop P F/F 90 is reset to "0" and the flip-flop IE F/F 118 is reset, disabling interrupts. During "Reset" all control lines are in the inactive state. When NRESET becomes logic 1, the data system accesses location X'0000'. The NINT (Not-Interrupt) signal is used to interrupt the normal operation of the data system. An interrupt is accepted only if the following are true: NINT=logic 0, IE F/F 118 is set, and the data system has completed executing the current instruction. When interrupted, the data system saves the current memory address, disables interrupts (resets IE F/F 118), generates an interrupt-acknowledge (NINTA), and forces a jump to memory location X'OFF'. The NTEST (Not-Test) signal is used to dump the contents of the internal ROM 43 and is used by support systems for test purposes.

Instruction words contained in the ROM 43 and read out onto the data bus 64 comprise an instruction set having specified formats. A preferred instruction set for use with the present invention is set forth in Table II.

TABLE II

| | | INSTRUCTION SET |
|---|---|---|
| HEX OP-CODE | MNEMONIC | DESCRIPTION AND SEQUENCE |
| 5 | MVI R,I | MOVE IMMEDIATE VALUE TO R (R)<br>I→R (R) |
| 7 | OUT A,R | LOAD OUTPUT DEVICE ADDRESSED BY A FROM R (R)<br>R (R)→OUT (A) |
| 1 | CAL A | CALL SUBROUTINE AT A; PUT RETURN |

TABLE II-continued

| HEX OP-CODE | MNEMONIC | INSTRUCTION SET DESCRIPTION AND SEQUENCE |
|---|---|---|
| | | ADDRESS IN STACK. |
| | | A = A1 . A2→MA:MA #2→STACK |
| 8 | MOV T,R | MOVE R (R) TO T,R (R)→T |
| 20 | BTO A | JUMP TO ADDRESS A IF BIT 0 of T IS TRUE. |
| | | IF TO = 1, MA11-8 . A2→MA |
| D | CMP R,T | COMPARE T TO R (R) |
| | | T-R (R) |
| 2C | BNE A | JUMP TO ADDRESS. |
| | | A IF NOT ZERO FLAG = L. |
| | | CF N2 = 1, MA11-8 . A2→MA |
| A | ADD R,T | ADD T TO R (R), RESULTS TO R (R) |
| | | T#R (R)→R (R) |
| 4 | LCB R,I,A | LOAD T WITH R (R): COMPARE T TO I; JUMP ON NOT ZERO TRUE TO ADDRESS A. MA#2→MA; R (R)→T; |
| | | T-I; NZ . (M11L-8 . A2) + Z. |
| | | MA#1→MA |
| 0 | JMP A | JUMP TO ADDRESS A |
| | | A = A1 . A2→MA |
| 6 | INP R,A | LOAD R (R) WITH DATA OF INPUT DEVICE ADDRESSED BY A. |
| | | INP (A)→R (R) |
| B | AND R,T | LOGICAL AND T WITH R (R) RESULTS TO R (R) |
| | | T . R (R)→R (R) |
| F2 | RFS | RETURN FROM SUBROUTINE; POP RETURN ADDRESS FROM STACK |
| | | STACK→MA |

In accordance with the present invention, the electrophotographic machine 10 is switched into a diagnostic state by first entering a jam condition. Assuming the machine is ready for copying, this is done by initiating the print switch 32 but manually inhibiting the movement of copy sheets in holder 17 by feed rollers 18. The selector switch 31 is then set at 38, i.e. units position, lever 37 set to 8 and tens position lever 38 set to 3. Thus, window 37*a* will display 8 and window 38*a* will display 3. The print switch 32 is then activated while the tens position lever 38 of the selector 31 switch is decremented to zero. That is, the selector switch 31 will sequentially output 38-28-18-08. At the end of the sequence, window 37*a* will display 8 and window 38*a* will display 0. Still activating the print switch 32, the units position lever 37 is decremented to zero. That is, selector switch 31 will sequentially output 08, 07, 06, 05, to 00. In effect, the diagnostic state is obtained by using the start print switch 32 and the selector switch 31 in a manner analogous to a combination padlock. Only this exact sequence advances the controller 35 to the diagnostic state.

In operation, as best illustrated in FIG. 5, the jam condition initiates a sequence of events. Block 140 and block 142 (output L15), represent the storing of a binary number in register L15 of RAM 46, seen in FIG. 4. The contents of register L15 are then moved to an external register (not shown) to control the operation of certain machine elements. In particular, at this time the LED 33 on operator's console 30 will indicate a jam condition and the fans, the fuser, the drives, the exposure, the platen solenoid, and a billing meter are inactivated. At this point, block 144, Call Input, the contents of the selector switch 31 are input to register L13 of RAM 46.

Since the contents of the selector switch 31 are manifested by only 6 bits and the L13 register is 8 bits, the 2 highest bits, 6 and 7, of register L13 are set to zero. In block 146, the status of the print switch 32 is read into the zero bit position of register L14 of RAM 46. That is, a logic 1 in the zero bit position represents that the print switch is inactivated and a logic zero in the zero bit position represents that the print switch is activated. The contents of register L14 indicating the status of the print switch 32 are then moved to the register TR 74. If there is a logic 1 in the zero bit position (indicating print switch 32 off), the binary equivalent of hexadecimal number 38 is stored in the L0 register of RAM 46 illustrated by block 148. The sequence is repeated, loop J2, until the print switch is activated.

Activation of the print switch 32 at this point generally corresponds to the service representative setting the selector switch 31 to 38 and activating the print switch 32. The contents of the register L0, hexadecimal 38, are then shifted to TR 74. At this point, block 150 (Compare L0 to SELSW), the contents of TR 74 containing hexadecimal 38 from register L0 and the contents of the selector switch 31 stored in register L13 will be compared in ALU 45 operand registers AR 72 and BR 70. A decision, block 152, is then made based upon the compare operation.

If the contents of register L0 and register L13 are equal, logic 1, the binary equivalent of a −10 hexadecimal number will be moved to TR 74 and added to the contents of register L0, as illustrated in block 154. At this point, register L0 will contain the hexadecimal number 28. At the next decision point, block 156, it will be determined whether or not register L0 contains the binary equivalent of hexadecimal −8. If not, the sequence is repeated.

In effect, register L0 is set at 38 and compared to the selector switch 31. The setting of selector switch 31 to 38 produces a true compare with register L0 and L0 is decremented by 10 to 28 and then continually compared with the selector switch 31 until switch 31 is decremented to 28. Register L0 is then decremented to 18, 08 and −08 as the selection switch 31 is decremented to 18 and 08.

The block 156 decision is true when L0 has been decremented to the value of −08 (the hexidecimal value "F8" is the equivalent of −08). In this instance, no further comparison is made between L0 and the selector switch. Also, no further modification of L0 occurs and block 156 remains true.

The block 158 decision is a comparison of the selector switch and the value zero.

A compare "false", logic 0, at block 158 produces loop J4 or JAM until the units position of switch 31 has been decremented to zero. When the units portion of the selector switch 31 has been decremented from 8 to zero, and the contents of the L0 register is the binary equivalent of hexidecimal number −8, there will be a compare true in block 158. At this point, L6 in FIG. 4 will be set to the binary equivalent of 6. This is illustrated in block 160 and manifests the diagnostic state.

A preferred embodiment of the sequence illustrated in FIG. 5 is shown in Table III.

TABLE III

```
        JAM STATE HAS ONLY ONE NORMAL EXIT, THAT IS POWER UP
        RESET. THE DIAGNOSTICS STATE IS ACCESSED VIA THE JAM
                                STATE.
JAM     MVI     L15,X'08'       CLEAR OUTS, SET JAMLED
        OUT     0,L15           OUTPUT HERE IN CASE
                                OF JAM
                                DUE TO INTERUPT FAILURE
                                (WATCH DOG TIMER OVERFLOW)
        CAL     INPUT           INPUT AND MASK SELSW TO
                                L13, INPUT TO L14
        MOV     T,L14
        BTO     J2              IF: PRINT SW OFF-JMP J2
        MOV     T,LO
        CMP     L13,T           ELSE:
        BNE     J3              IF: SEL SW,EQ,MC (LSB)
        MVI     T,−X'10'         DECR MC BY X'10'
        ADD     L0,T            ELSE:
        LCB     L0,X',F8'JAM    IF: MC,EQ,X'F8'
        LCB     L13,X'00',JAM   ANDIF: SEL SW,EQ,00
        MVI     L6,6             SET SC = 6&
        JMP     INITO            JMP TO STATE 6
                                ELSE:
                                JMP TO JAM
                                ENDIF
                                ENDIF
                                ENDIF
J2      MVI     L0,X'38'        SET LSB OF MC = X'38'
        JMP     JAM             JMP TO JAM
      SUBROUTINE "INPUT" INPUTS THE SELECTOR SWITCH AND
        MASKS THE UNUSED BITS 6&7: SELSW VALUE THEN
        STORED IN L13. MACHINE INPUTS THEN STORED IN
                                L14.
INPUT   INP     L13,0           INPUT SEL SW TO L13
        MVI     T,X'3F'
        AND     L13,T           MASK UNUSED BITS 6&7
        INP     L14,1           INPUT MACH INPUTS TO L14
        RFS                     RETURN
        END
```

The sequence illustrated in FIG. 5 together with selector switch 31, controller 35, and interface 36 represent a preferred embodiment of the present invention. Although Table III represents a preferred embodiment of the sequence illustrated in FIG. 5, it should be noted that this sequence is readily implemented by the various registers, logic, and controls as disclosed. It should also be noted that various combinations of hardware and software will be apparent to those skilled in the art to provide the sequence illustrated in FIG. 5.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed is:

1. In an electrostatic printing apparatus having a plurality of processing stations and an operator's console provided with a print switch and a copy number select switch, the electrostatic printing apparatus adapted for operating in a first state for reproducing a predetermined number of copies of an original as determined by the copy selector switch and adapted for operation in a second state for diagnosing operation of selected processing stations, the method of placing the electrostatic printing apparatus in the second state comprising the steps of:

storing the equivalent of the number 38 in a register, setting the copy selector switch to number 38, continuously activating the print switch, comparing the number stored in the register with the number selected by the copy selector switch, if the number stored in the register equals the number set on the selector switch, decrementing the number stored in the register by the equivalent of ten, manually decrementing the tens position on the selector switch from 3 to 0, repeating the compare process until the register stores the equivalent of the number 08, again decrementing the number in the register by the equivalent of 10, and manually decrementing the units position of the copy selector switch from 8 to 0, activating an LED on the operator console to indicate the diagnostic status of the machine.

2. In an electrostatic printing apparatus having a plurality of processing stations and an operator's console provided with a plurality of machine instruction devices, the electrostatic printing apparatus adapted for operating in a first state for reproducing a predetermined number of copies of an original and adapted for operation in a second state for diagnosing operation of selected processing stations, the method of placing the electrostatic printing apparatus in the second state comprising the steps of:

initiating a malfunction condition, activating one of the plurality of instruction devices, again activating one of the plurality of instruction devices, whereby the apparatus is placed in the second state.

3. The method of claim 2 wherein the machine has a copy selector switch including the step of setting a first predetermined number with the copy selector switch and the step of changing the copy selector switch to a second predetermined number.

4. The method of claim 3 including the steps of:

storing the first predetermined number in a first register, comparing the number stored in the first register with the number set on the selector switch, if the number stored in the first register equals the number set on the selector switch, decrementing the number stored in the first register by a given factor, repeating the process until the number stored in the first register corresponds to the second predetermined number, manifesting the placement of the machine in the diagnostic mode.

5. The method of placing an electrostatic printing machine into a diagnostic state, the machine having a print switch and a copy selector switch, comprising the steps of:

(1) initiating a jam condition (2) setting the copy selector switch to a first predetermined position, (3) simultaneously activating the print switch and setting the copy selector switch to a second predetermined position.

6. In an electronic control having a plurality of processing stations and an operator's console provided with a start switch and a number select switch, the control adapted for operating in a first state for performing a predetermined process and adapted for operation in a second state for diagnosing operation of selected processing stations, the method of placing the control in the second state comprising the steps of:

selecting a first predetermined number on the selector switch, activating the start switch, and simultaneously changing the selector switch to a second predetermined number.

* * * * *